United States Patent [19]

Tshida et al.

[11] 3,941,115

[45] Mar. 2, 1976

[54] ENGINE COVER SUPPORTING APPARATUS OF INTERNAL COMBUSTION ENGINES

[75] Inventors: Naoyashi Tshida; Atsushi Watanabe; Yukio Ishii, all of Tamano, Japan

[73] Assignees: Mitsui Shipbuilding and Engineering Co., Ltd.; Japan Ship's Machinery Development Association, both of Tokyo, Japan

[22] Filed: Jan. 28, 1975

[21] Appl. No.: 544,847

Related U.S. Application Data

[63] Continuation of Ser. No. 354,742, April 24, 1973, abandoned.

[52] U.S. Cl. ..... 123/198 E; 123/90.39; 123/90.43; 123/195 C

[51] Int. Cl.[2] ..... F02B 77/00

[58] Field of Search ..... 123/90.38, 195 C, 198 E, 123/90.47, 90.39, 90.43; 220/38

[56] References Cited

UNITED STATES PATENTS

| | | | |
|---|---|---|---|
| 1,199,596 | 9/1916 | Noll | 220/38 |
| 1,507,165 | 9/1924 | Fekete | 123/90.38 |
| 1,741,677 | 12/1929 | Brewer | 123/90.43 |
| 2,650,578 | 9/1953 | Daub | 123/90.39 |
| 2,681,165 | 6/1954 | Kornhauser | 220/38 |
| 2,724,378 | 11/1955 | Wellman | 123/198 E |
| 3,396,712 | 8/1968 | Sakraida | 123/198 E |
| 3,758,174 | 9/1973 | Kuhn | 123/195 C |

*Primary Examiner*—Charles J. Myhre
*Assistant Examiner*—Daniel J. O'Connor
*Attorney, Agent, or Firm*—Charles E. Pfund

[57] ABSTRACT

An engine cover removably secured to the cylinder head of an internal combustion engine for housing suction and exhaust valves and a valve operating mechanism is provided with an arm which is pivotally connected to a stationary support located close to one side of the engine so that the cover can be rotated or shifted in the lateral direction.

4 Claims, 4 Drawing Figures

ENGINE COVER SUPPORTING APPARATUS OF INTERNAL COMBUSTION ENGINES

This is a continuation, of application Ser. No. 354,742, filed Apr. 24, 1973 now abandoned.

BACKGROUND OF THE INVENTION

This invention relates to a large size internal combustion engine installed in a ship, more particularly an engine cover supporting apparatus of an internal combustion engine.

It is necessary to frequently disassemble an internal combustion engine for the purpose of inspecting and repairing its various component parts such as suction valves, exhaust valves, a fuel injection device, piston, etc.

To disassemble the engine, first the engine cover is removed and then valve operating levers. In a large size internal combustion engine, these relatively small component parts must also be handled with an overhead crane. Furthermore, such removed component parts must be placed near the engine. However, it is impossible to place a large number of the removed components parts near the engine in an engine room of a limited space. In other words, it is impossible to dismount a large number of component parts at a time.

Moreover, when transporting the dismounted component part to an inspection or repair shop, care should be taken not to cause the component parts to collide against near obstacles and not to drop oil from the component parts. Such transportation requires much labour and cost.

SUMMARY OF THE INVENTION

It is an object of this invention to provide an improved engine cover which can be readily rotated or shifted in the lateral direction to prepare for the inspection or repair various component parts of the engine.

Another object of this invention is to provide an improved engine cover which is not required to be moved over a large vertical distance or moved to a remote station at the time of disassembling the engine.

Briefly stated, according to this invention there is provided an engine cover removably secured to the cylinder head of an internal combustion engine characterized in that an arm is secured to the cover and one end of the arm is pivotally connected to a stationary support located close to one side of the engine.

DESCRIPTION OF THE PREFERRED EMBODIMENTS

Figure 1:
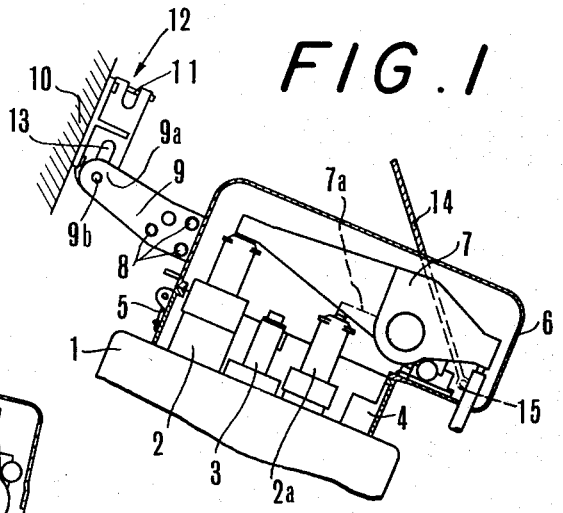
FIG. 1 shows a diagrammatic side view, partly in section of an engine cover mounted in position on the top of a cylinder head.
Figure 2:
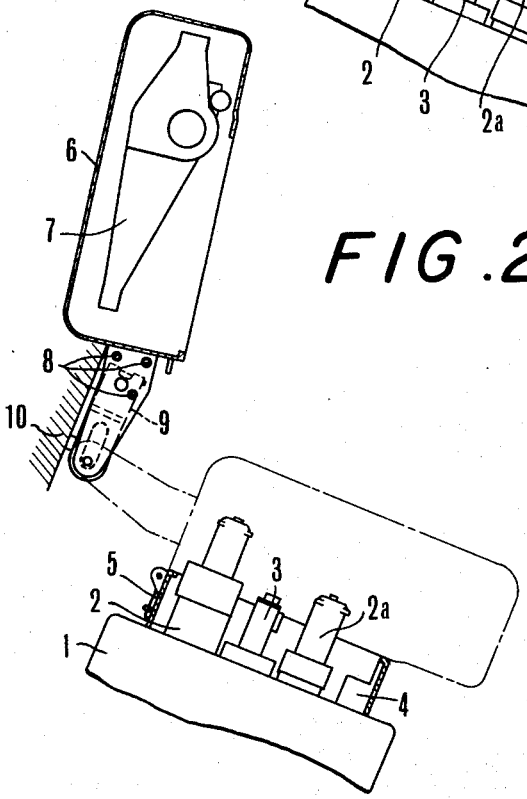
FIG. 2 is a similar side view showing the cover held in a removed position.

In an embodiment shown in FIGS. 1 and 2, a cylinder head 1 of a large size internal combustion engine is provided with a suction valve 2, an exhaust valve 2*a* and a fuel injection nozzle 3 on its upper surface. The suction and exhaust valves are operated by valve operating levers 7 and 7*a*. A cover consisting of a lower section 4 secured to the cylinder head 1 and an upper section 6 connected to the lower section 4 by means of bolts 5 is provided to contain the valves and the valve operating levers.

According to this invention, an arm 9 is connected to one side of the upper section 6 by means of bolts 8, for example. The outer end 9*a* of the arm 9 is pivotally connected to a bracket 12 which is connected to a stationary support 10 by means of bolts 11, the support 10 being shaped to support and accommodate the upper section of the cover as shown in FIG. 2. An elongated slot 13 is formed at the lower end of bracket 12 to provide a lost motion connection with a pin 9*b* at the end 9*a* of arm 9. To remove the cover, a wire rope 14 hung on an overhead crane, not shown, is connected to a hook 15 secured to the upper section 6 of the cover and the upper section 6 is disconnected from the lower section 4 by removing the bolts 5. Thereafter, the wire rope is raised to rotate the upper section 6 in the counter clockwise direction about pin 9*b* thereby supporting the upper section by stationary support 10 as shown in FIG. 2. In this embodiment, the valve operating levers 7 and 7*a* are pivotally supported by the upper section 6 of the cover so that these levers are also removed together with the upper section. In order to prevent damage to the suction and exhaust valves, the upper section 6 is raised slightly before rotation. The elongated slot 13 permits this.

Once the upper section of this cover has been rotated in this manner, the exposed suction and exhaust valves can be readily inspected. Further, the cylinder head 1 can also be removed readily.

Figure 3:
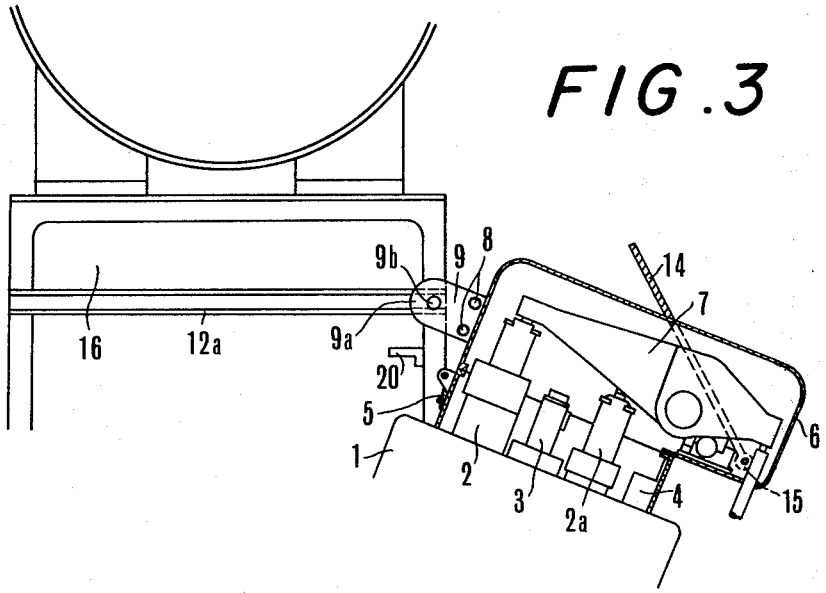
FIGS. 3 and 4 show views similar to FIGS. 1 and 2 respectively but illustrating another embodiment of this invention.
Figure 4:
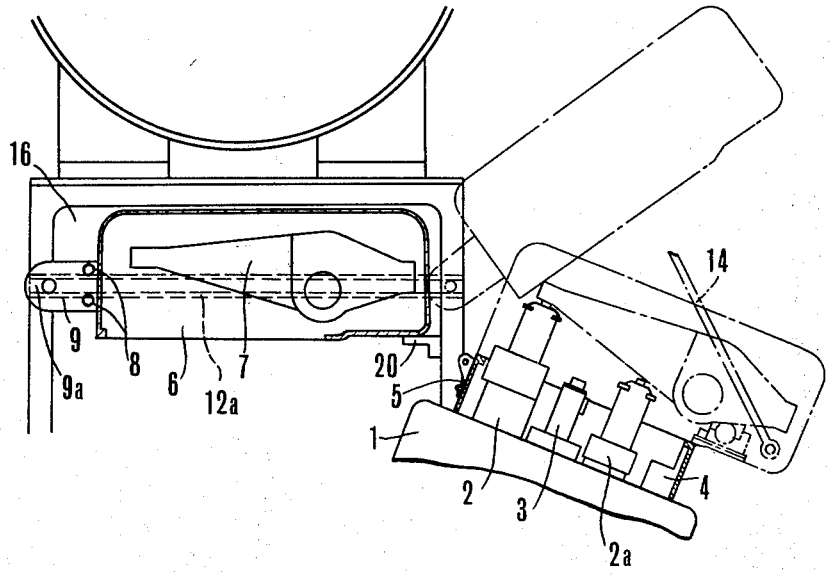

FIGS. 3 and 4 show a modified embodiment for an application where an ample space 16 is available on one side of the engine for accommodating the covers. In this embodiment, a pin or the roller 9*b* at the end 9*a* of the arm 9 is placed between a pair of guide rails 12*a* to be slidable therealong. The disconnected upper section 6 is moved to the solid line position shown in FIG. 4 from the position shown in FIG. 3. When contained in the space 16, the right-hand end of the upper section 6 is supported by a shelf 20 thus preventing the upper section from falling down.

In this manner, according to this invention, it is possible to readily remove and rotate or shift the engine cover to a stationary support on one side of the engine. Accordingly, it is not necessary to lower the removed cover to the floor of the engine room or to transport it to a remote shop. Thus, it is not necessary to raise and lower the cover over a large distance, thus greatly simplifying the operation of the crane and saving the floor space. For this reason, the invention is suitable for use in ships or the like where the available space is limited although the invention has been shown and described in terms of some preferred embodiments thereof it should be understood that many changes and modifications will be obvious to one skilled in the art without departing from the true spirit and scope of the invention.

What is claimed is:

1. In an engine, a two part cover secured to the cylinder head of a heavy internal combustion engine and adapted to be stored when removed, said cover comprising a lower section secured to the cylinder head of said engine to surround the suction and exhaust valves, and an upper section removably mounted on said lower section and adapted to be stored when removed; an operating mechanism of said suction and exhaust valves pivotally mounted in said upper section, an arm secured at one end to said upper section; means for pivotally securing the other end of said arm to a stationary support located close to one side of said engine; and retaining means for said upper section for holding said upper section in a stored position so as to expose said cylinder head and said valves with said retaining means operable for releasing said upper section from said stored position to return to its mounted position on said lower section.

2. The engine cover according to claim 1 wherein said support comprises a bracket secured to a stationary structure.

3. The engine cover according to claim 1 wherein said stationary support comprises a pair of parallel guide rails and roller means mounted on said other end of said arm received between said rails to be slidable therealong.

4. The engine cover according to claim 1 wherein said bracket includes an elongated slot and said arm is connected to said bracket by means of a pin extending through said elongated slot.

* * * * *

UNITED STATES PATENT AND TRADEMARK OFFICE

CERTIFICATE OF CORRECTION

PATENT NO. : 3,941,115

DATED : March 2, 1976

INVENTOR(S) : Atsushi Watanabe, Yukio Ishii, Naoyoshi Ishida

It is certified that error appears in the above-identified patent and that said Letters Patent are hereby corrected as shown below:

In the legend, correct the name of the first listed inventor from "Naoyashi Tshida" to -- Naoyoshi Ishida --.

Column 1, line 5, correct the filing date of "April 24, 1973" to -- April 26, 1973 -- line 24, change "components" to -- component --.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*